US011825590B2

(12) United States Patent
Lee et al.

(10) Patent No.: US 11,825,590 B2
(45) Date of Patent: Nov. 21, 2023

(54) DRIFT TUBE, APPARATUS AND ION IMPLANTER HAVING VARIABLE FOCUS ELECTRODE IN LINEAR ACCELERATOR

(71) Applicant: Applied Materials, Inc., Santa Clara, CA (US)

(72) Inventors: William Davis Lee, Rockport, ME (US); Charles T. Carlson, Cedar Park, TX (US)

(73) Assignee: Applied Materials, Inc., Santa Clara, CA (US)

( * ) Notice: Subject to any disclaimer, the term of this patent is extended or adjusted under 35 U.S.C. 154(b) by 185 days.

(21) Appl. No.: 17/473,015

(22) Filed: Sep. 13, 2021

(65) Prior Publication Data

US 2023/0083050 A1 Mar. 16, 2023

(51) Int. Cl.

| | |
|---|---|
| ***H05H 9/04*** | (2006.01) |
| ***H05H 7/22*** | (2006.01) |
| ***H05H 7/00*** | (2006.01) |

(52) U.S. Cl.

CPC ..... *H05H 9/042* (2013.01); *H05H 7/001* (2013.01); *H05H 7/22* (2013.01); *H05H 2007/007* (2013.01); *H05H 2007/222* (2013.01)

(58) Field of Classification Search

None

See application file for complete search history.

(56) References Cited

U.S. PATENT DOCUMENTS

| | | | | |
|---|---|---|---|---|
| 4,667,111 A * | 5/1987 | Glavish | H01J 37/3171 | 315/505 |
| 5,296,714 A * | 3/1994 | Treglio | H01J 27/08 | 315/111.41 |
| 5,796,219 A * | 8/1998 | Hirakimoto | H05H 7/12 | 315/506 |
| 5,801,488 A * | 9/1998 | Fujisawa | H05H 9/00 | 315/505 |
| 5,907,158 A * | 5/1999 | Nasser-Ghodsi | H01J 37/3171 | 250/492.21 |

(Continued)

FOREIGN PATENT DOCUMENTS

| | | | |
|---|---|---|---|
| DE | 3616569 A * | 11/1986 | H01J 37/3171 |
| GB | 2209242 A * | 5/1989 | H05H 9/00 |

(Continued)

OTHER PUBLICATIONS

International Search Report and Written Opinion for the International Patent Application No. PCT/US2022/041673, dated Dec. 22, 2022, 7 pages.

*Primary Examiner* — Srinivas Sathiraju

(74) *Attorney, Agent, or Firm* — KDW Firm PLLC

(57) ABSTRACT

A drift tube may include a middle portion, arranged as a hollow cylinder, and coupled to receive an RF voltage signal. The drift tube may include a first end portion, adjacent to and electrically connected to the middle portion. The middle portion and the first end portion may define a central opening to conduct an ion beam therethrough, along a direction of beam propagation. The first end portion may include a first focus assembly, and a second focus assembly, where the first focus assembly and the second focus assembly are movable with respect to one another along the direction of beam propagation, from a first configuration to a second configuration.

20 Claims, 5 Drawing Sheets

(56) References Cited

U.S. PATENT DOCUMENTS 6,242,747 B1 * 6/2001 Sugitani ..... H05H 9/00 250/251
6,262,638 B1 * 7/2001 Scherer ..... H05H 7/02 315/505
6,291,828 B1 * 9/2001 Saadatmand ..... H01J 37/3171 250/492.21
6,320,334 B1 * 11/2001 Roberge ..... H01J 37/304 315/505
6,326,746 B1 * 12/2001 Chen ..... H05H 9/00 315/505
6,423,976 B1 * 7/2002 Glavish ..... H01J 37/3171 315/505
6,653,643 B2 11/2003 Saadatmand
6,777,893 B1 * 8/2004 Swenson ..... H05H 9/00 315/505
6,949,895 B2 * 9/2005 DiVergilio ..... H01J 37/12 315/505
7,098,615 B2 * 8/2006 Swenson ..... H05H 9/00 315/505
7,767,561 B2 * 8/2010 Hanawa ..... H01J 37/32357 257/E21.057
8,324,810 B2 * 12/2012 Kazakov ..... H05H 7/06 315/505
9,269,541 B2 * 2/2016 Inada ..... H01J 37/304
9,591,740 B2 3/2017 Belchenko
10,505,334 B2 * 12/2019 Yang ..... H01J 23/06
10,651,011 B2 * 5/2020 Sinclair ..... H01J 37/20
10,943,767 B1 * 3/2021 Kowal ..... G06F 1/04
10,991,546 B1 * 4/2021 Kowal ..... H01J 37/3171
11,089,670 B2 * 8/2021 Mishin ..... H05H 7/02
11,160,158 B1 * 10/2021 Nguyen ..... H05H 9/048
11,189,460 B1 * 11/2021 Carlson ..... H01J 37/3007
11,217,427 B1 * 1/2022 Renau ..... H01J 37/045
11,388,810 B2 * 7/2022 Kurunczi ..... H01J 37/3171
11,476,087 B2 * 10/2022 Sinclair ..... H01J 37/3171
11,569,063 B2 * 1/2023 Murphy ..... H01J 37/304
11,576,252 B2 * 2/2023 Kowal ..... H05H 7/02
11,596,051 B2 * 2/2023 Biloiu ..... H05H 7/18
2002/0084427 A1 * 7/2002 Saadatmand ..... H05H 9/00 250/492.1
2003/0038254 A1 * 2/2003 Saadatmand ..... H01J 37/3171 315/505
2009/0314949 A1 * 12/2009 Plettner ..... H05H 7/06 250/397
2010/0072401 A1 * 3/2010 Parrill ..... H01L 21/26506 250/492.21
2010/0072405 A1 * 3/2010 Yu ..... H01J 25/02 250/493.1
2011/0260047 A1 * 10/2011 Lee ..... H01L 21/26513 250/282
2011/0297845 A1 * 12/2011 Ota ..... H01J 37/20 250/492.3
2012/0175518 A1 * 7/2012 Godet ..... H01J 37/244 250/492.21
2013/0118305 A1 * 5/2013 Marston ..... C22B 4/08 75/10.67
2014/0188416 A1 * 7/2014 McIntyre ..... H01L 21/68707 702/64
2014/0345522 A1 * 11/2014 Kabasawa ..... H01L 21/26506 118/688
2014/0361197 A1 * 12/2014 Lee ..... H01J 37/3171 269/287
2015/0228523 A1 * 8/2015 Lee ..... H01L 21/6831 361/234
2016/0005564 A1 * 1/2016 Chaney ..... H01J 37/08 250/423 R
2016/0174355 A1 * 6/2016 Lal ..... H05H 9/045 315/505
2016/0293154 A1 * 10/2016 Yang ..... G10K 11/172
2017/0213684 A1 * 7/2017 Lee ..... H01J 27/022
2017/0221678 A1 * 8/2017 Likhanskii ..... H01J 37/3007
2018/0120504 A1 * 5/2018 Qi ..... G02B 6/3636
2018/0197716 A1 * 7/2018 Sasaki ..... H05H 9/041
2018/0276164 A1 * 9/2018 Das Sharma ..... G06F 13/4265
2019/0371562 A1 * 12/2019 Sinclair ..... H01J 37/05
2020/0066486 A1 * 2/2020 Sinclair ..... H01J 37/3007
2020/0234918 A1 * 7/2020 Sinclair ..... H01J 37/3007
2020/0357603 A1 * 11/2020 Sinclair ..... H01J 37/20
2021/0074508 A1 * 3/2021 Lee ..... H01J 37/244
2021/0307152 A1 * 9/2021 Kowal ..... H05H 7/02
2022/0037116 A1 * 2/2022 Sinclair ..... H01J 37/3007
2022/0248523 A1 * 8/2022 Sinclair ..... H05H 7/02

FOREIGN PATENT DOCUMENTS

JP 2001052897 A * 2/2001 ..... H01J 37/32
KR 101890514 B1 8/2018

* cited by examiner

DRIFT TUBE, APPARATUS AND ION IMPLANTER HAVING VARIABLE FOCUS ELECTRODE IN LINEAR ACCELERATOR

FIELD OF THE DISCLOSURE

The disclosure relates generally to ion implantation apparatus and more particularly to high energy beamline ion implanters.

BACKGROUND OF THE DISCLOSURE

Ion implantation is a process of introducing dopants or impurities into a substrate via bombardment. Ion implantation systems may comprise an ion source and a series of beam-line components. The ion source may comprise a chamber where ions are generated. The ion source may also comprise a power source and an extraction electrode assembly disposed near the chamber. The beam-line components, may include, for example, a mass analyzer, a first acceleration or deceleration stage, a collimator, and a second acceleration or deceleration stage. Much like a series of optical lenses for manipulating a light beam, the beam-line components can filter, focus, and manipulate ions or ion beam having particular species, shape, energy, and/or other qualities. The ion beam passes through the beam-line components and may be directed toward a substrate mounted on a platen or clamp.

Implantation apparatus capable of generating ion energies of approximately 1 MeV or greater are often referred to as high energy ion implanters, or high energy ion implantation systems. One type of high energy ion implanter employs a linear accelerator, or LINAC, where a series of electrodes arranged as tubes conduct and accelerate the ion beam to increasingly higher energy along the succession of tubes, where the electrodes receive an AC voltage signal. Known (RF) LINACs are driven by an RF voltage applied a generally in the MHZ range, such as 1 MHz to 700 MHz.

One issue for operation of RF LINAC ion implanters is the usefulness of the ability to process ions of different mass/charge ratio (m/q). For a given acceleration stage, ions are accelerated along a drift tube assembly that includes multiple electrodes, configured as hollow cylinder drift tubes that conduct an ion beam through each drift tube. The drift tube assembly includes at least one powered electrode and a ground electrode that define a fixed focus length for focusing the ion beam as conducted through the drift tube assembly. The focusing length of a given drift tube of the drift tube assembly may be chosen as a compromise so that acceleration of different species of differing m/q ratios may be accomplished, at the expense of reduced focusing performance.

With respect to these and other considerations the present disclosure is provided.

BRIEF SUMMARY

In one embodiment, a drift tube is provided. The drift tube may include a middle portion, arranged as a hollow cylinder, and coupled to receive an RF voltage signal. The drift tube may include a first end portion, adjacent to and electrically connected to the middle portion. The middle portion and the first end portion may define a central opening to conduct an ion beam therethrough, along a direction of beam propagation. The end portion may include a first focus assembly, and a second focus assembly, where the first focus assembly and the second focus assembly are movable with respect to one another along the direction of beam propagation, from a first configuration to a second configuration.

In another embodiment, an apparatus may include a first grounded drift tube, a second grounded drift tube, downstream of the first grounded drift tube, and an AC drift tube assembly disposed between the first grounded drift tube and the second grounded drift tube. The AC drift tube assembly may include at least a first AC drift tube, where the first AC drift tube includes a middle portion, arranged as a hollow cylinder. The first AC drift tube may also include a first end portion, adjacent to and electrically connected to the middle portion. The middle portion and the first end portion may define a central opening to conduct an ion beam therethrough, along a direction of beam propagation. The first end portion may include a first focus assembly, and a second focus assembly, where the first focus assembly and the second focus assembly are movable with respect to one another along the direction of beam propagation, from a first configuration to a second configuration.

In a further embodiment, an ion implanter may include an ion source to generate an ion beam; and a linear accelerator, to transport and accelerate the bunched ion beam. The linear accelerator may include a plurality of acceleration stages, wherein a given acceleration stage of the plurality of acceleration stages includes a drift tube assembly, arranged to transmit the ion beam along a direction of beam propagation. The drift tube assembly may include a first grounded drift tube, a second grounded drift tube, downstream of the first grounded drift tube; and an AC drift tube assembly, comprising at least a first AC drift tube. The first AC drift tube may include a middle portion; and a first end portion, adjacent to the middle portion. The first end portion may include a plurality of focus assemblies that are movable with respect to one another along the direction of beam propagation.

Figure 1A:
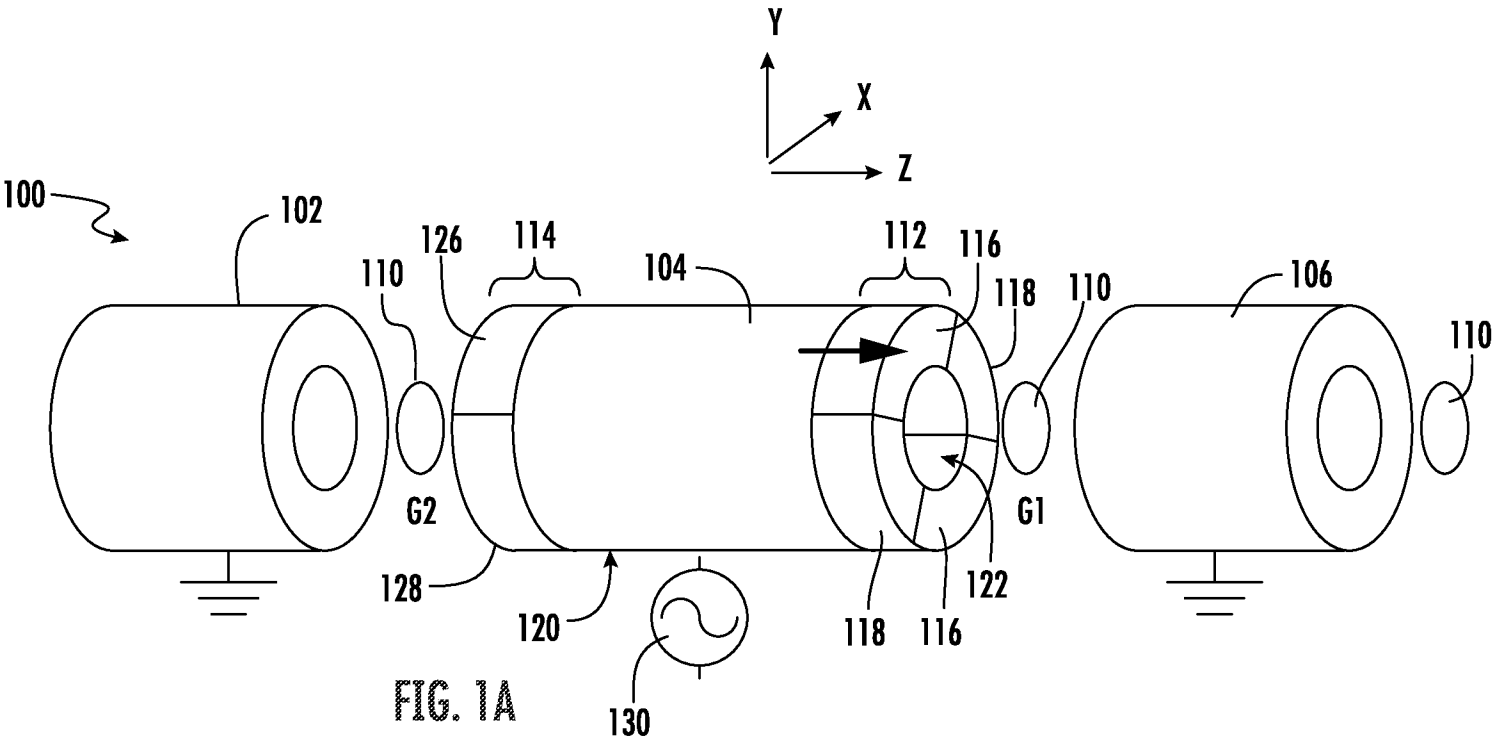
FIG. 1A shows a perspective view of an exemplary apparatus, in a first configuration, according to embodiments of the disclosure.

The drawings are not necessarily to scale. The drawings are merely representations, not intended to portray specific parameters of the disclosure. The drawings are intended to depict exemplary embodiments of the disclosure, and therefore are not be considered as limiting in scope. In the drawings, like numbering represents like elements.

DETAILED DESCRIPTION

An apparatus, system and method in accordance with the present disclosure will now be described more fully hereinafter with reference to the accompanying drawings, where embodiments of the system and method are shown. The system and method may be embodied in many different forms and are not be construed as being limited to the embodiments set forth herein. Instead, these embodiments are provided so this disclosure will be thorough and complete, and will fully convey the scope of the system and method to those skilled in the art.

Terms such as "top," "bottom," "upper," "lower," "vertical," "horizontal," "lateral," and "longitudinal" may be used herein to describe the relative placement and orientation of these components and their constituent parts, with respect to the geometry and orientation of a component of a semiconductor manufacturing device as appearing in the figures. The terminology may include the words specifically mentioned, derivatives thereof, and words of similar import.

As used herein, an element or operation recited in the singular and proceeded with the word "a" or "an" are understood as potentially including plural elements or operations as well. Furthermore, references to "one embodiment" of the present disclosure are not intended to be interpreted as precluding the existence of additional embodiments also incorporating the recited features.

Provided herein are approaches for improved high energy ion implantation systems and components, based upon a beamline architecture, and in particular, ion implanters based upon linear accelerators. For brevity, an ion implantation system may also be referred to herein as an "ion implanter." Various embodiments entail novel approaches that provide the capability of flexibly adjusting the effective drift length within acceleration stages of a linear accelerator.

FIG. 1A shows an exemplary apparatus, in a first configuration, according to embodiments of the disclosure. The apparatus 100 represents a drift tube assembly and associated components for accelerating an ion beam 110 in an acceleration stage of a linear accelerator. In particular, the apparatus 100 defines a double gap acceleration stage arrangement, where an ion beam is conducted through two accelerating gaps within the apparatus 100. The apparatus 100 may be coupled to an RF power assembly 130 that drives various components of the drift tube assembly with an RF signal. The RF power assembly 130 is shown schematically without details, and may include a power source, resonator, network, and other known components. The drift tube assembly is arranged as a series of hollow tubes to conduct an ion beam therethrough. The ion beam 110 is accelerated when crossing the gap G1 and the gap G2.

As shown in FIG. 1A, the drift tube assembly may include a first ground electrode, shown as first grounded drift tube 102, an AC drift tube assembly, disposed downstream of the first ground electrode; and a second ground electrode, shown as second grounded drift tube 106, disposed downstream of the AC drift tube assembly. As detailed in the discussion to follow, the AC drift tube assembly may include at least one AC drift tube. In the embodiment of FIG. 1A, the AC drift tube assembly is embodied as a single AC drift tube, shown as AC drift tube 104.

As in known linear accelerators, the AC drift tube 104 may be coupled to receive RF voltage from the RF power assembly 130, in order to generate a time varying electric field across G1 and G2. The RF power assembly 130 may include an RF power source and resonator (not separately shown) as in known LINACs. This time varying RF field will operate to accelerate the ion beam 110 across these gaps in order to increase the energy of ion beam 110. As in known linear accelerators, in operation, the apparatus 100 is configured with a central opening 122 to conduct the ion beam 110 therethrough. In particular, in operation the ion beam 110 may be received as a bunched ion beam that traverses the gaps G1 and gap G2 as a series of ion packets. Accordingly, by timing the entry of the packets of ion beam 110 with the RF field applied across gaps G1 and gap G2, the amplitude of the RF field operating on the ion beam 110 may be optimized for maximum acceleration of the ion beam 110.

In addition to accelerating the ion beam 110, the apparatus 100 includes components to apply a variable focus to the ion beam 110. As shown in FIG. 1, the AC drift tube 104 includes a middle portion 120, arranged as a hollow cylinder. The AC drift tube 104 further includes a first end portion 112, adjacent to and electrically connected to the middle portion 120. As such, the middle portion 120 and the first end portion 112 define at least a part of the central opening 122. According to embodiments of the disclosure, the first end portion 112 may include multiple parts that are movable with respect to one another to provide adjustment of focusing of the ion beam 110. This ability to provide variable beam focusing means that the focusing of a given ion beam may be adjusted, and additionally, facilitates the ability to optimize focusing for different types of ion beams, such as when the species of ion beam 110 are changed, and in particular where the m/q ratio differs between different ion beam species.

In the embodiment of FIG. 1A, the different focusing parts are shown as a first focus assembly 116, and a second focus assembly 118. As further depicted with respect to the embodiments to follow in FIGS. 2A-4, the first focus assembly 116 and second focus assembly 118 are movable with respect to one another along a direction parallel to the direction of beam propagation, meaning along the Z-axis of the Cartesian coordinate system shown, either in the direction of the ion beam propagation, or in the opposite direction to ion beam propagation. For example, in one embodiment, the first focus assembly 116 may be configured to move outwardly from the middle portion 120, while the second focus assembly may remain fixed. Note that the first end portion 112 may be electrically connected to the middle portion 120 so the applied voltage to the AC drift tube 104 is applied to the first end portion 112. As such, when the first focus assembly 116 is moved, the configuration of the first end portion 112 will change from a first configuration to a second configuration, where the electric field in the gap G2 may change in a manner that adjusts the focusing of the ion beam 110 while traversing the gap G2.

Figure 1B:
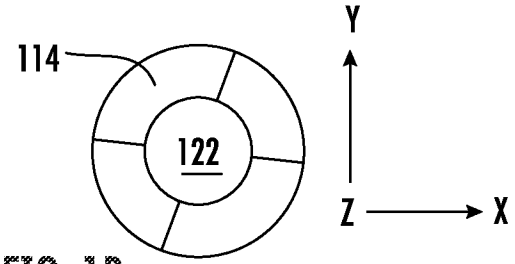
FIG. 1B shows an end view of the apparatus of FIG. 1A.

As shown in this embodiment of FIG. 1A, and more particularly, in FIG. 1B, the first end portion 112 will generally form a ring structure that defines a part of the central opening 122 of the AC drift tube 104. While the embodiment of FIG. 1A and FIG. 1B depicts a first end portion 112 having two focus assemblies, formed of four total parts, in other embodiments, an end portion to provide variable beam focusing may include a first focus assembly, a second focus, assembly, and a third focus assembly, for example. Moreover, a given focus assembly may include more than two parts, for example.

As further shown in FIG. 1A, the AC drift tube 104 may include a second end portion 114, arranged adjacent the middle portion 120, on the upstream side, and arranged at the downstream side of gap G2. As such, the second end portion 114 may be arranged similarly to the first end portion 112, where the second end portion 114 includes a fourth focus assembly 126, and a fifth focus assembly 128, wherein the fourth focus assembly 126 and the fifth focus assembly 128 are movable with respect to one another along the direction of beam propagation (Z-axis). As such, the second end portion 114 may provide variable beam focusing in the gap G2, similarly to the variable beam focusing provided by the first end portion 112 in gap G1.

While the configuration of FIG. 1A illustrates four total parts or sections for a given end portion, according to some embodiments of the disclosure, a focus assembly may include 4 N sections, where N is an integer. As such, these configurations may provide a quadrupole configuration that generates quadrupole fields for focusing and defocusing of an ion beam.

Moreover, in some embodiments, one or more AC drift tubes may be configured to provide multiple quadrupole configurations (quadrupoles), where the quadrupole fields generated by the different quadrupoles may or may not differ from one another. Because a given quadrupole will inherently de-focus an ion beam in one direction and focus the ion beam in the other direction, in some embodiments, the AC drift tube assembly may be arranged to generate a pair of quadrupoles, or alternatively, a triplet of quadrupoles, in order to balance out focusing of an ion beam in different directions. In one non-limiting example, a doublet may be set so the first quadrupole provides defocus of an ion beam in the "x" direction while aggressively focusing the ion beam in the "y" direction, while the second quadrupole is set to focus the ion beam in the "x" direction while merely gently defocusing the ion beam in the "y:direction. As a result, such a quadrupole pair together may generate a net focusing in both directions, "x" and "y." Thus, a first focus assembly in a first end portion of an AC drift tube assembly may be placed in a first configuration to generate a first quadrupole that has a first focusing effect on an ion beam. At the same time, a second focus assembly in a second end portion of the AC drift tube assembly may be placed in a second configuration to generate a second quadrupole that has a second focusing effect on the ion beam, in order to generate an overall targeted focusing effect on the ion beam.

Figure 2A:
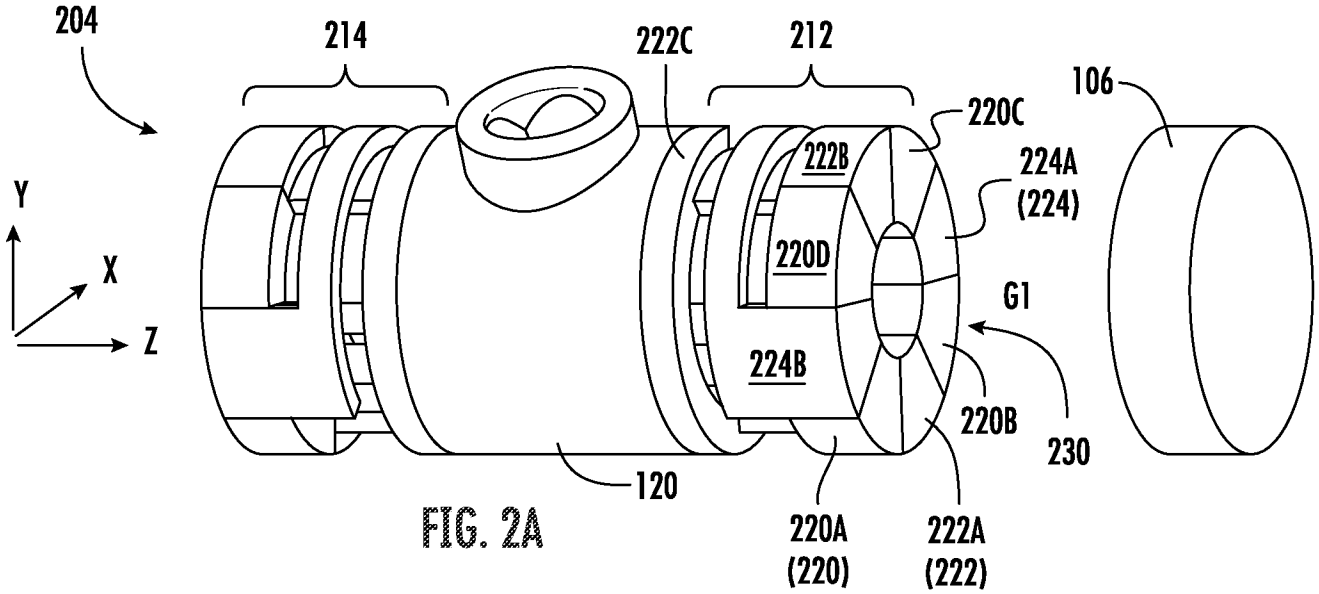
FIG. 2A shows a perspective view of another exemplary apparatus, in a first configuration, according to embodiments of the disclosure.
Figure 2B:
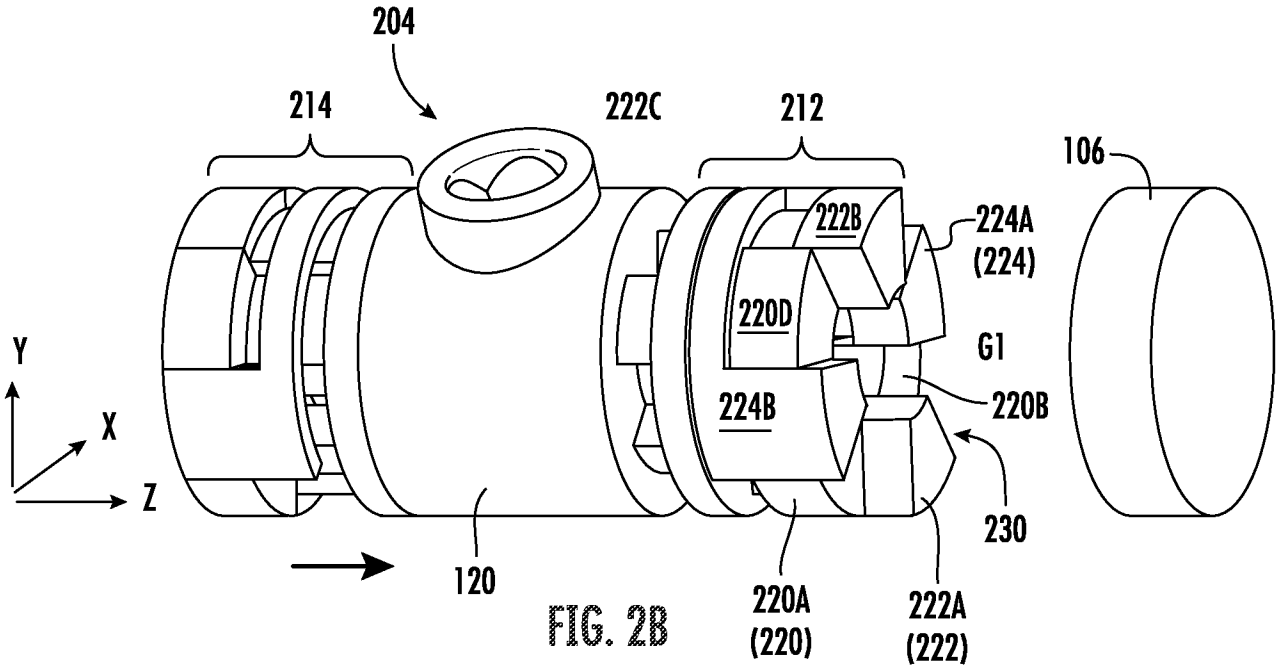
FIG. 2B shows the exemplary apparatus of FIG. 2A, in a second configuration, according to embodiments of the disclosure.

Turning now to FIG. 2A there is shown a perspective view of another exemplary apparatus, in a first configuration, according to embodiments of the disclosure. FIG. 2B shows the exemplary apparatus of FIG. 2A, in a second configuration, according to embodiments of the disclosure. The apparatus in this case may be employed as an AC drift tube, similarly to the function of the AC drift tube 104, described above. As such, the apparatus will be referred to as AC drift tube 204. Note that, as with the AC drift tube 104, the AC drift tube 204 may be coupled to an RF assembly (not separately shown) to receive an RF voltage for accelerating an ion beam across accelerating gaps at opposite ends of the AC drift tube 204 (see gaps G1 and G2 in FIG. 1A for reference).

In FIG. 2A, the AC drift tube 204 is shown in a first configuration, including a middle portion 120, first end portion 212, and second end portion 214. According to various embodiments the first end portion 212 and second end portion 214 may include multiple focus assemblies that are movable with respect to one another to change the focusing configuration of the AC drift tube 204. Note that for simplicity of explanation the focusing assemblies of the second end portion 214 are not changed in the different configurations shown between FIG. 2A and FIG. 2B. However, according to various embodiments, the focusing assemblies of second end portion 214 may be adjusted in concert with or instead of the adjusting the focusing assemblies of first end portion 212.

Figure 2C:
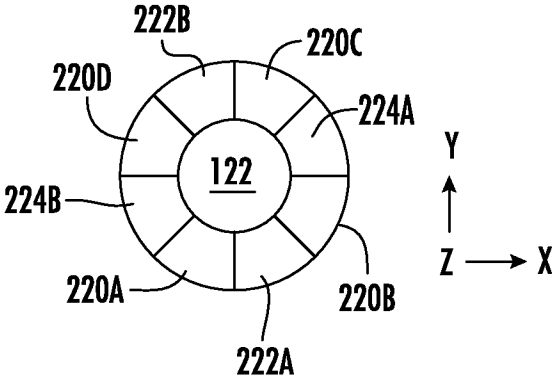
FIG. 2C shows an end view of the apparatus of FIG. 2A.

As shown in FIG. 2A, in the first configuration the first end portion 212 defines a planar surface that lies within a first plane (x-y plane), extending perpendicularly to the direction of beam propagation (Z-axis). Note that the first end portion 212 is formed by a combination of a first focus assembly, a second focus assembly, and a third focus assembly. The first focus assembly 220 is in turn composed of a focusing element 220A, focusing element 220B, focusing element 220C, and focusing element 220D. The second focus assembly 222 is composed of a focusing element 222A and a focusing element 222B. The third focus assembly 224 is formed of a focusing element 224A and a focusing element 224B. Together, the outer X-Y plane surfaces of the various focusing elements of the first end portion 212 define a ring structure, where the ring structure has a planar surface extending in the X-Y plane in the configuration of FIG. 2A. The four focus elements of the first focus assembly 220 may be arranged at 90 degree intervals around the circumference of the ring structure, as shown in the view of FIG. 2C, while the two focus elements of the second focus assembly 222 and third focus assembly 224 may be arranged at 180 degree intervals, as shown. However, in other embodiment, focus assemblies may be configured differently. As such, because the focus assemblies of first end portion define a single X-Y plane, the gap G1 may be uniform, between the outer surface 230 of the first end portion 212 and a grounded drift tube 106, for example.

Turning now to FIG. 2B, in the second configuration shown therein, the first end portion 212 defines a crenellated surface, or castellated surface. In the particular example shown, the first focus assembly (including the focusing element 220A, and the focusing element 220B, focusing element 220C, and focusing element 220D) has not moved with respect to FIG. 2A. The second focus assembly (including the focusing element 222A, and the focusing element 222B) and the third focus assembly (including the focusing element 224A, and focusing element 224B) have moved outwardly (downstream) from the middle portion 120. According to different non-limiting embodiments of the disclosure, the mechanism for moving a focus assembly may be provided by a mechanical means, electrical means, magnetic means, piezo-electric means, pneumatic means, or hydraulic means. As such, because the outer surface 230 of first end portion 212 is crenellated, the electric fields across the gap G1 may be more complex in structure as compared to the configuration in FIG. 2A. This second configuration of FIG. 2B may accordingly provide a different degree of focusing as compared to the focusing of the first configuration of FIG. 2A. Said differently, the configuration of FIG. 2A may provide a suitable focusing for an ion beam of a first m/q ratio, while the configuration of FIG. 2B provides a suitable focusing for an ion beam of a second m/q ratio, different from the first m/q ratio.

In the embodiment of FIGS. 2A-2B the focusing elements of the different focus assemblies have a general shape of a finger or crenellation, where the focusing elements within a given focus assembly, such as second focus assembly 222 or within third focus assembly 224, are mechanically coupled to one another in that focus assembly, so as to be movable in concert with one another. Thus, in the second focus assembly 222 and in the third focus assembly 224, a first finger of a pair of fingers is disposed opposite a second finger of the pair of fingers, and connected to a common ring-shaped connecting base. These base structures are shown as connecting base 222C and connecting base 224C, which bases are configured to allow independent movement of the fingers of second focus assembly 222 and third focus assembly 224 with respect to the focus assembly 220, and independent movement of fingers of the second focus assembly 222 with respect to the fingers of focus assembly 224. Thus, as shown in FIG. 2B, the relative position of the fingers of the second focus assembly 222 along the Z-axis is different than the position of the fingers of focus assembly 224, and the relative position of the fingers of the first focus assembly 220 is different from the positions of the fingers of second focus assembly 222 and the fingers of focus assembly 224.

Note that according to some embodiments, the fingers of second focus assembly 222 and the fingers of third focus assembly 224 may be independently movable in a continuous fashion with respect to one another and with respect to the focus assembly 220. Thus, the electric fields generated by the AC drift tube 204 may be adjusted in a smooth, continuous fashion by incremental movement of the second focus assembly 222 and/or incremental movement of the focus assembly 224.

As an example, in the configuration of FIG. 2B, where the fingers of the second focus assembly 222 and fingers of third focus assembly 224 extend more closely to the grounded drift tube 106 than the fingers of focus assembly 220, the second focus assembly 222 and third focus assembly 224 may together define a quadrupole field. As such, when an RF voltage is applied between the AC drift tube 204 and the grounded drift tube 106, an ion beam 110 may be accelerated by the electric fields generated across the gap G1, while experiencing a quadrupole field applying a suitable focusing effect in the x-direction, y-direction, or both directions.

Note also, that the various focus assemblies of the embodiment of FIG. 2A and FIG. 2B may be movable back and forth with respect to one another along an axis parallel to the direction of beam propagation (Z-axis), thus, either in the direction of beam propagation or opposite the direction of beam propagation. In this manner, an ion beam passing through the AC drift tube 204, and crossing the gap G1 may be brought into more focus, or defocused, by a suitable relative motion of the focus assemblies.

Note that according to some embodiments, the second end portion 214 may be adjustable in a manner similar to the aforementioned embodiment of FIGS. 2A-2B. Moreover, according to some embodiments, the first end portion 212 may be independently adjustable with respect to the second end portion 214, so that the focusing effect of electric fields across the gap G1 may differ from the focusing effect of electric fields across the gap G2.

In accordance with different embodiments of the disclosure, an AC drift tube having plurality of focusing assemblies, such as the AC drift tube 204, may be arranged in a triple gap acceleration stage, or alternatively, in a double gap acceleration stage.

Figure 3:
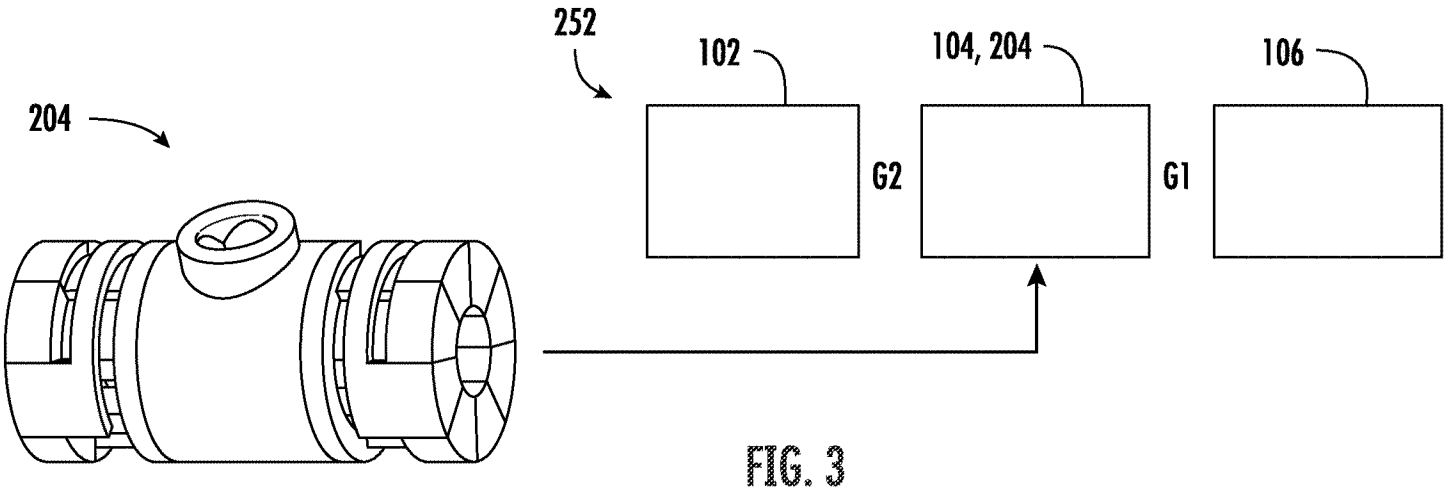
FIG. 3 shows an exemplary drift tube assembly, according to embodiments of the disclosure.

To illustrate these alternative embodiments, FIG. 3 shows an exemplary drift tube assembly, according to embodiments of the disclosure, arranged in an acceleration stage. The double gap drift tube assembly 252 includes a first grounded drift tube 102, an AC drift tube, and a second grounded drift tube 106. The AC drift tube is shown as AC drift tube 104, or alternatively, AC drift tube 204. The double gap drift tube assembly 252 includes just one AC drift tube, as shown, arranged adjacent the downstream side of Gap G2, and adjacent the upstream side of Gap G1. In various embodiments, as discussed above, the AC drift tube of FIG. 3 may include two end portions, arranged adjacent the respect gaps G1 and G2. As such, by adjusting the focus assemblies of one or both of the end portions in the double gap configuration of FIG. 3, the beam focusing across gap G1 and across gap G2 may be independently varied.

Figure 4:
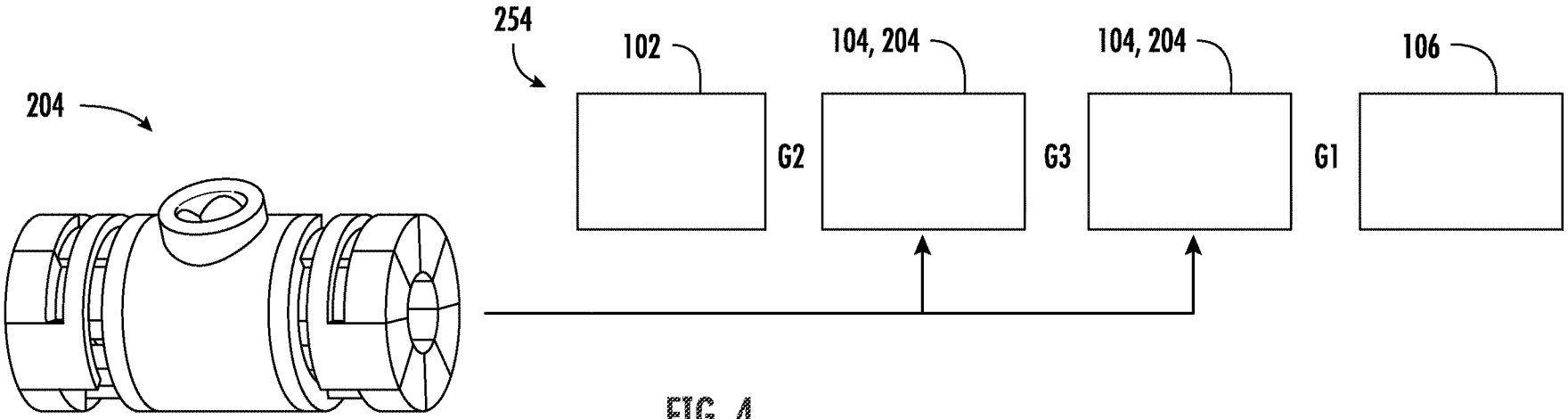
FIG. 4 shows another exemplary drift tube assembly, according to embodiments of the disclosure.

FIG. 4 shows another exemplary drift tube assembly, according to embodiments of the disclosure. The triple gap drift tube assembly 254 includes a first grounded drift tube 102, an AC drift tube, and a second grounded drift tube 106. The triple gap drift tube assembly 254 also includes a pair of AC drift tubes, adjacent to one another, where each AC drift tube is shown as AC drift tube 104, or alternatively, AC drift tube 204. The upstream AC drift tube is arranged adjacent the downstream side of Gap G2, and adjacent the upstream side of a Gap G3. The downstream AC drift tube is arranged adjacent the downstream side of Gap G3, and adjacent the upstream side of a Gap G1.

Note that according to some embodiments, similarly to the case with FIG. 3, the focusing effect of electric fields across the gap G1 may differ from the focusing effect of electric fields across the gap G2, and the focusing effect of electric fields across the gap G3 may differ from the focusing effect of electric fields across gap G2 and the focusing effect of electric fields across the gap G1. In particular, the two AC drift tubes of FIG. 4 may include a middle portion and two end portions on a given AC drift tube. A first drift tube may include a first middle portion, a first end portion and second end portion, while a second drift tube includes an additional middle portion, an additional first end portion, etc. The corresponding components located on the first drift tube and the second drift tube (e.g., first middle portion, and additional middle portion) may be the same as one another or may differ from one another. Thus, by adjusting the appropriate focus assemblies on the appropriate end portions, focusing the beam focusing across gap G1 and across gap G2 may be independently varied. In addition, the beam focusing across gap G3 may be independently adjusted with respect to beam focusing across gap G1 or gap G2.

Figure 5:
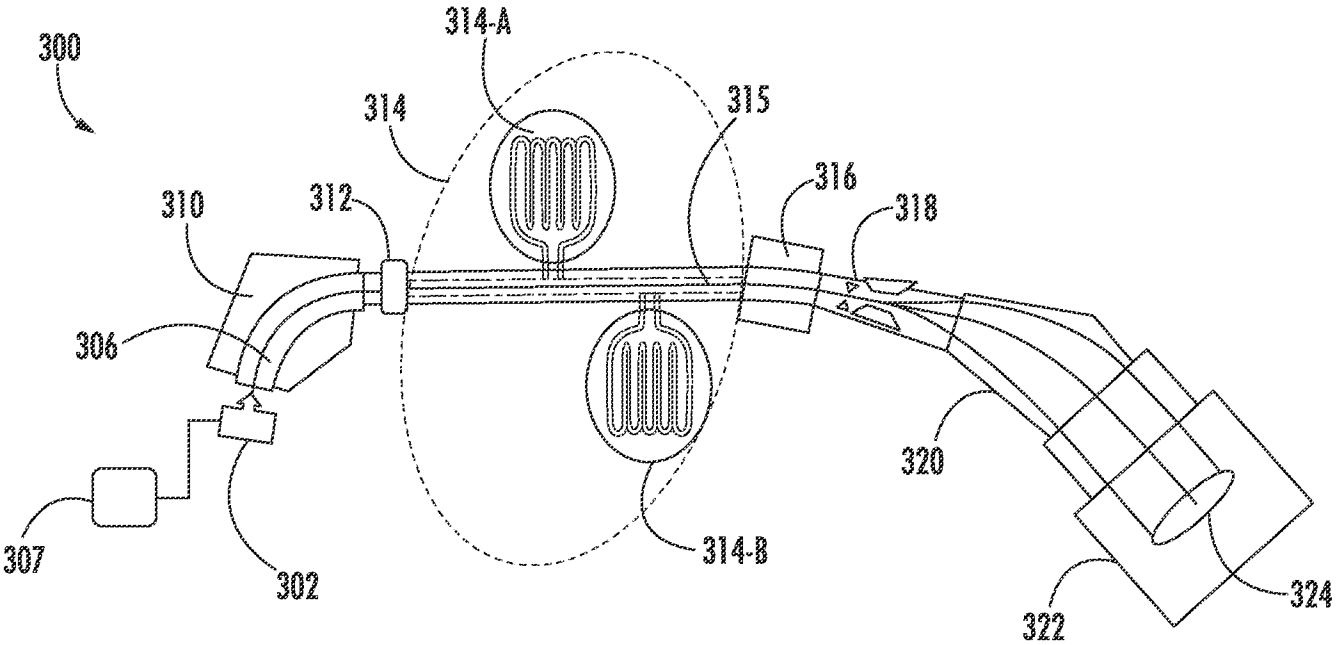
FIG. 5 presents an exemplary ion implantation system.

FIG. 5 depicts a schematic of an ion implanter, according to embodiments of the disclosure. The ion implanter 300 includes acceleration stages 314-A, 314-B of a LINAC, shown as linear accelerator 314. The ion implanter 300, may represent a beamline ion implanter, with some elements not shown for clarity of explanation. The ion implanter 300 may include an ion source 302, and a gas box 307 as known in the art. The ion source 302 may include an extraction system including extraction components and filters (not shown) to generate an ion beam 306 at a first energy. Non-limiting examples of suitable ion energy for the first ion energy range from 5 keV to 270 keV, while the embodiments are not limited in this context. To form a high energy ion beam, the ion implanter 300 includes various additional components for accelerating the ion beam 306.

The ion implanter 300 may include an analyzer 310, functioning to analyze the ion beam 306 as in known apparatus, by changing the trajectory of the ion beam 306, as shown. The ion implanter 300 may also include a buncher 312, and a linear accelerator 314 (shown in the dashed line), disposed downstream of the buncher 312, where the linear accelerator 314 is arranged to accelerate the ion beam 306 to form a high energy ion beam 315, greater than the ion energy of the ion beam 306, before entering the linear accelerator 314. The buncher 312 may receive the ion beam 306 as a continuous ion beam and output the ion beam 306 as a bunched ion beam to the linear accelerator 314. The linear accelerator 314 may include a plurality of acceleration stages (314-A, 314-B, to 314-N (not shown)), arranged in series, as shown. In various embodiments, the ion energy of the high energy ion beam 315 may represent the final ion energy for the ion beam 306, or approximately the final ion energy. In various embodiments, the ion implanter 300 may include additional components, such as filter magnet 316, a scanner 318, collimator 320, where the general functions of the scanner 318 and collimator 320 are well known and will not be described herein in further detail. As such, a high energy ion beam, represented by the high energy ion beam 315, may be delivered to an end station 322 for processing a substrate 324. Non-limiting energy ranges for the high energy ion beam 315 include 500 keV-10 MeV, where the ion energy of the ion beam 306 is increased in steps through the various acceleration stages of the linear accelerator 314. In accordance with various embodiments of the disclosure, one or more of the acceleration stages of the linear accelerator 314 may include a double gap or a triple gap drift tube assembly having at least one variable focus AC drift tube couple, as detailed with respect to the embodiments of FIGS. 1A-4. An advantage provided by the ion implanter 300 is that the beam focus provided by one or more acceleration stages may be adjusted according to different ion species having different m/q ratios and therefore different velocities when transported through the acceleration stages of the linear accelerator 314.

Note that the variable focus drift tube assemblies as set forth herein may be implemented in one or more stages of a LINAC according to various considerations. In some implementations, a variable focus drift tube assembly may be provided throughout the different stages of a LINAC, from the most upstream stage to the most downstream stage. In some implementations, such as where final ion energy is relatively high, such as greater than 1 MeV, greater than 2 MeV, or greater than 3 MeV, variable focus drift tube assemblies may be placed just in upstream stages, such as the first several stages of a LINAC. In these upstream stages, where ion energy of the ion beam being accelerated is still relatively lower, a variable focus drift tube may exert a stronger effect than in downstream stages, where the ion energy may be so high, wherein the focus effect generated by a variable focus drift tube assembly is both not very powerful and not very needed. Thus, for purposes of reducing complexity or cost, variable focus drift tube assemblies may be placed just in the most upstream stages before ion energy becomes too high.

In other implementations, where the targeted final ion energy is relatively lower, such as below 2 MeV, variable focus drift tube assemblies may be effective and needed in all LINAC stages, and thus may be located in each LINAC stage.

In view of the above, the present disclosure provides at least the following advantages. As a first advantage, the variable focus drift tube assembly of the present embodiments provides the ability to set the optimal focus matching a specific m/q for any given ion, thus increasing flexibility and efficiency for processing different ions in a given ion implanter. Another advantage is the ability to minimize or eliminate other focusing elements from a beamline, such as bulky quadrupoles that are used in known LINACs.

While certain embodiments of the disclosure have been described herein, the disclosure is not limited thereto, as the disclosure is as broad in scope as the art will allow and the specification may be read likewise. Therefore, the above description are not to be construed as limiting. Those skilled in the art will envision other modifications within the scope and spirit of the claims appended hereto.

The invention claimed is:

1. A drift tube, comprising:

a middle portion, arranged as a hollow cylinder, the middle portion coupled to receive an RF voltage signal;

a first end portion, adjacent to and electrically connected to the middle portion, the middle portion and the first end portion defining a central opening to conduct an ion beam therethrough, along a direction of beam propagation;

wherein the first end portion comprises:

a first focus assembly; and a second focus assembly, wherein the first focus assembly and the second focus assembly are movable with respect to one another along the direction of beam propagation, from a first configuration to a second configuration.

2. The drift tube of claim 1, wherein the first end portion comprises a ring structure, the ring structure defining a portion of the central opening.

3. The drift tube of claim 2, wherein at least the second focus assembly comprises a pair of fingers, disposed around the central opening within the ring structure, wherein a first finger and a second finger of the pair of fingers are disposed opposite one another along the ring structure.

4. The drift tube of claim 1, wherein:

in the first configuration, the first end portion defines a planar surface that lies within a first plane, extending perpendicularly to the direction of beam propagation; and in the second configuration, the first end portion defines a crenellated surface.

5. The drift tube of claim 1, wherein the first focus assembly is fixed to the middle portion, and wherein the second focus assembly is movable along an axis parallel to the direction of beam propagation.

6. The drift tube of claim 5, the first end portion further comprising a third focus assembly, independently movable along the axis parallel to the direction of beam propagation, with respect to the second focus assembly.

7. The drift tube of claim 6, wherein the first end portion comprises a ring structure, the ring structure defining a portion of the central opening, wherein the second focus assembly comprises a first pair of fingers, disposed around the central opening within the ring structure, wherein a first finger and a second finger of the first pair of fingers are disposed opposite one another along the ring structure, and wherein the third focus assembly comprises a second pair of fingers, disposed around the central opening within the ring structure, wherein a first finger and a second finger of the second pair of fingers are disposed opposite one another along the ring structure, wherein second focus assembly and the third focus assembly define a quadrupole configuration.

8. The drift tube of claim 1, further comprising a second end portion, disposed adjacent to and electrically connected to the middle portion, and opposite the first end portion;

wherein the second end portion comprises:

a fourth focus assembly; and a fifth focus assembly, wherein the fourth focus assembly and the fifth focus assembly are movable with respect to one another along the direction of beam propagation.

9. An apparatus, comprising:

a first grounded drift tube;

a second grounded drift tube, downstream of the first grounded drift tube; and an AC drift tube assembly, disposed between the first grounded drift tube and the second grounded drift tube, the AC drift tube assembly comprising at least a first AC drift tube, the first AC drift tube having:

a middle portion, arranged as a hollow cylinder; and a first end portion, adjacent to and electrically connected to the middle portion, the middle portion and the first end portion defining a central opening to conduct an ion beam therethrough, along a direction of beam propagation, wherein the first end portion comprises:

a first focus assembly; and a second focus assembly, wherein the first focus assembly and the second focus assembly are movable with respect to one another along the direction of beam propagation, from a first configuration to a second configuration.

10. The apparatus of claim 9, wherein the first end portion comprises a ring structure, the ring structure defining a portion of the central opening.

11. The apparatus of claim 10, wherein at least the second focus assembly comprises a pair of fingers, disposed around the central opening within the ring structure, wherein a first finger and a second finger of the pair of fingers are disposed opposite one another along the ring structure.

12. The apparatus of claim 9, wherein:

in the first configuration, the first end portion defines a planar surface that lies within a first plane, extending perpendicularly to the direction of beam propagation; and in the second configuration, the first end portion defines a crenellated surface.

13. The apparatus of claim 9, wherein the first focus assembly is fixed to the middle portion, and wherein the second focus assembly is movable along an axis parallel to the direction of beam propagation.

14. The apparatus of claim 13, the first end portion further comprising a third focus assembly, independently movable along the axis parallel to the direction of beam propagation, with respect to the second focus assembly.

15. The apparatus of claim 14, wherein the second focus assembly comprises a first pair of fingers, disposed around the central opening within the ring structure, wherein a first finger and a second finger of the first pair of fingers are disposed opposite one another along a ring structure, and wherein the third focus assembly comprises a second pair of fingers, disposed around the central opening within the ring structure, wherein a first finger and a second finger of the second pair of fingers are disposed opposite one another along the ring structure, wherein second focus assembly and the third focus assembly define a quadrupole configuration.

16. The apparatus of claim 9, the AC drift tube assembly further comprising a second AC drift tube, the second AC drift tube having:

an additional middle portion, arranged as a hollow cylinder to conduct the ion beam therethrough, along the direction of beam propagation;

an additional first end portion, adjacent to and electrically connected to the additional middle portion, wherein the additional first end portion comprises:

an additional first focus assembly; and and additional second focus assembly, wherein the additional first focus assembly and the additional second focus assembly are movable with respect to one another along the direction of beam propagation, from a third configuration to a fourth configuration.

17. An ion implanter, comprising:

an ion source to generate an ion beam; and a linear accelerator, to transport and accelerate the ion beam as a bunched ion beam, the linear accelerator comprising a plurality of acceleration stages, wherein a given acceleration stage of the plurality of acceleration stages comprises a drift tube assembly, arranged to transmit the ion beam along a direction of beam propagation, the drift tube assembly comprising:

a first grounded drift tube;

a second grounded drift tube, downstream of the first grounded drift tube; and an AC drift tube assembly, disposed between the first grounded drift tube and the second grounded drift tube, the AC drift tube assembly comprising at least a first AC drift tube, the first AC drift tube having:

a middle portion; and a first end portion, adjacent to the middle portion, the middle portion and the first end portion defining a central opening to conduct an ion beam therethrough, along the direction of beam propagation, wherein the first end portion comprises a plurality of focus assemblies that are movable with respect to one another along the direction of beam propagation.

18. The ion implanter of claim 17, wherein the first end portion comprises a ring structure, the ring structure defining a portion of the central opening.

19. The ion implanter of claim 17, wherein:

in a first configuration, the first end portion defines a planar surface that lies within a first plane, extending perpendicularly to the direction of beam propagation; and in a second configuration, the first end portion defines a crenellated surface.

20. The ion implanter of claim 17, the AC drift tube assembly further comprising a second AC drift tube, disposed between the first grounded drift tube and the second grounded drift tube, the second AC drift tube having:

an additional middle portion, arranged as a hollow cylinder to conduct the ion beam therethrough, along the direction of beam propagation;

an additional first end portion, adjacent to and electrically connected to the additional middle portion, wherein the additional first end portion comprises:

an additional first focus assembly; and and additional second focus assembly, wherein the additional first focus assembly and the additional second focus assembly are movable with respect to one another along the direction of beam propagation, from a third configuration to a fourth configuration.

* * * * *